US005134852A

United States Patent [19]

Weeks

[11] Patent Number: 5,134,852

[45] Date of Patent: Aug. 4, 1992

[54] CLAM SHELL TYPE Y-JOINT

[75] Inventor: Andrew M. Weeks, Jackson, Mich.

[73] Assignee: Tennessee Gas Pipeline Company, Lincolnshire, Ill.

[21] Appl. No.: 571,181

[22] Filed: Aug. 23, 1990

[51] Int. Cl.[5] ..... F01N 7/10; F16L 1/06

[52] U.S. Cl. ..... 60/323; 137/602; 285/155; 285/373

[58] Field of Search ..... 60/323, 319, 276, 322, 60/313; 137/602; 29/890.08, 890.14, 890.148, 890.144, 890.149, 517, 518, 237; 285/155, 419, 373, 286

[56] References Cited

U.S. PATENT DOCUMENTS

| | | | |
|---|---|---|---|
| 2,479,578 | 7/1949 | Langvand | 29/890.14 |
| 3,238,605 | 3/1966 | Hills . | |
| 3,242,558 | 3/1966 | Selig | 29/890.08 |
| 3,248,791 | 5/1966 | Powers | 29/890.08 |
| 3,788,284 | 1/1974 | Gardner | 60/276 |
| 4,131,007 | 12/1978 | Laundy . | |
| 4,145,881 | 3/1979 | Poullot | 60/276 |
| 4,621,494 | 11/1986 | Fujita | 60/313 |
| 4,655,035 | 4/1987 | Sager et al. | 60/307 |
| 4,656,830 | 4/1987 | Ohno et al. | 60/276 |
| 4,745,742 | 5/1988 | Nada et al. | 60/276 |
| 4,793,135 | 12/1988 | Obstfelder et al. | 60/274 |
| 4,833,882 | 5/1989 | Yasuda et al. | 60/276 |
| 4,869,063 | 9/1989 | Sakurai et al. | 60/313 |
| 4,926,634 | 5/1990 | Pütz et al. | 60/274 |

FOREIGN PATENT DOCUMENTS

| | | | |
|---|---|---|---|
| 0798402 | 5/1936 | France | 29/890.148 |
| 1064606 | 5/1954 | France | 29/157 |
| 0154120 | 11/1981 | Japan | 29/890.08 |
| 0108817 | 6/1984 | Japan | 60/313 |
| 0116813 | 6/1985 | Japan | 60/313 |
| 0144937 | 10/1931 | Switzerland | 29/890.14 |
| 0205253 | 10/1939 | Switzerland | 29/890.148 |
| 0236079 | 9/1984 | Switzerland | 29/890.14 |

*Primary Examiner*—Ira S. Lazarus
*Assistant Examiner*—L. Heyman
*Attorney, Agent, or Firm*—Harness, Dickey & Pierce

[57] ABSTRACT

A Y-shaped, clam shell type coupling device for use in automotive vehicle exhaust systems to couple two exhaust pipes that are connected to an engine manifold to a single exhaust pipe that is connected to a catalytic converter or exhaust silencing device. The clam shell type coupling comprises a pair of mirror image half shells which combine around the exhaust pipes in fluid tight fashion to form two generally tubular intersecting chambers. One of the chambers may provide a direct pathway from one of the manifold exhaust pipes to the single exhaust pipe.

12 Claims, 2 Drawing Sheets 80
88
52
64
62
80

70
64
56
74
88
52
58
80
76
P
θ
92
86
82
62
80
84
60
72

80
60
84
80
62
52

62
86
80
52

CLAM SHELL TYPE Y-JOINT

BACKGROUND OF THE INVENTION

This invention relates generally to a coupling device for coupling two pipes to a single pipe, and more specifically, to a coupling device useful in trucks and automobiles for coupling exhaust pipes extending from the manifolds of a V-6 or a V-8 engine to a single inlet pipe of a catalytic converter or exhaust silencing apparatus.

Typically, in a V-6 or V-8 internal combustion engine exhaust manifolds are located on opposite sides of the engine to carry away exhaust from the cylinders of the engine. Therefore, at least two exhaust pipes extend from the engine. However, since conventional catalytic converters and silencing apparatus such as mufflers utilize a single inlet, it is necessary for the two separate exhaust pipes from a dual manifold system to be combined into a single exhaust pipe before the exhaust gases are introduced into the catalytic converter or muffler.

Accordingly, it is desirable, then to have a practical and efficient method of combining the separate pipes from a dual exhaust manifold system into a single pipe for introducing the exhaust gases into a catalytic converter or muffler. The joinder area combining the separate exhaust pipes from the manifolds must be of sufficient strength to maintain the integrity of the entire exhaust system and must be configured to minimize back pressure on the exhaust gases as they are combined into the single pipe. In addition, the method or device for joining the two separate pipes into a single pipe must be readily carried out and must be versatile so that it can be adapted to be utilized for a variety of different engines having different dual manifold exhaust systems and catalytic converter or muffler requirements.

SUMMARY OF THE INVENTION

It is an objective of this invention to provide an apparatus and method for joining two exhaust pipes from the manifolds of an internal combustion engine into a single exhaust pipe which is strong and provides satisfactory gas flow and ease of installation.

According to the present invention, a clam shell type coupling device having a Y-shaped configuration is provided to couple two separate exhaust pipes extending from exhaust manifolds on opposite sides of a V-6 or V-8 internal combustion engine into a single exhaust pipe. The clam shell type coupling device comprises two mirror image half shells which are configured to receive in a fluid tight manner two inlet pipes from the engine and an outlet pipe to a catalytic converter or muffler. The half shells combine to form two tubular shaped intersecting chambers for combining the gases within the coupling device. Each half shell is generally Y-shaped thereby enabling a pair of inlet pipes to be attached to one end of the coupling device and an outlet pipe to be attached to the other end. They are welded together by means of flanges running along the peripheral edges of both half shells. The clam shell type coupling device is also welded to each of the pipes. The half shells may be welded together before or after the pipes are inserted into and welded to the clam shell device.

The openings formed by combining the two half shells are adapted to receive an exhaust pipe in fluid tight manner and configured such that the combined cross sectional area of the two inlets is substantially equivalent to the cross sectional area of the outlet opening so that minimum pressure is created in the exhaust gases as they are combined. If the exhaust system includes a catalytic converter, an aperture can be included in either one of the half shells to provide a means for the introduction of secondary air into the exhaust gases, thus enabling more efficient conversion of the unused exhaust by-products in the catalytic converter. Alternatively, the aperture may provide a means for the attachment of a gas sensor to sense the presence of oxygen in the exhaust gasses and alert an on-board computer to adjust the vehicle's fuel mixture and combustion timing.

The present invention, then, provides a coupling apparatus of sufficient integrity and strength such that the joint between the two pipes from the dual exhaust manifolds of an internal combustion engine maintains the structural integrity of the rest of the exhaust system.

FIG. 2 of U.S. Pat. No. 4,131,007, issued Dec. 26, 1978, entitled "Coupling Device for Connecting a Plurality of Ports to One Pipe—Method of Making Same", shows a clam shell type coupling device.

Further objects and advantages, residing in the construction, arrangement, and combination of features in structural parts of the coupling device will become apparent and clear from a consideration of the following detailed description with reference to the accompanying drawings.

DETAILED DESCRIPTION OF AN EMBODIMENT OF THE INVENTION

The following description of an embodiment of the present invention according to the drawings is exemplary and is not intended in any way to limit the invention or its use.

Figure 1:
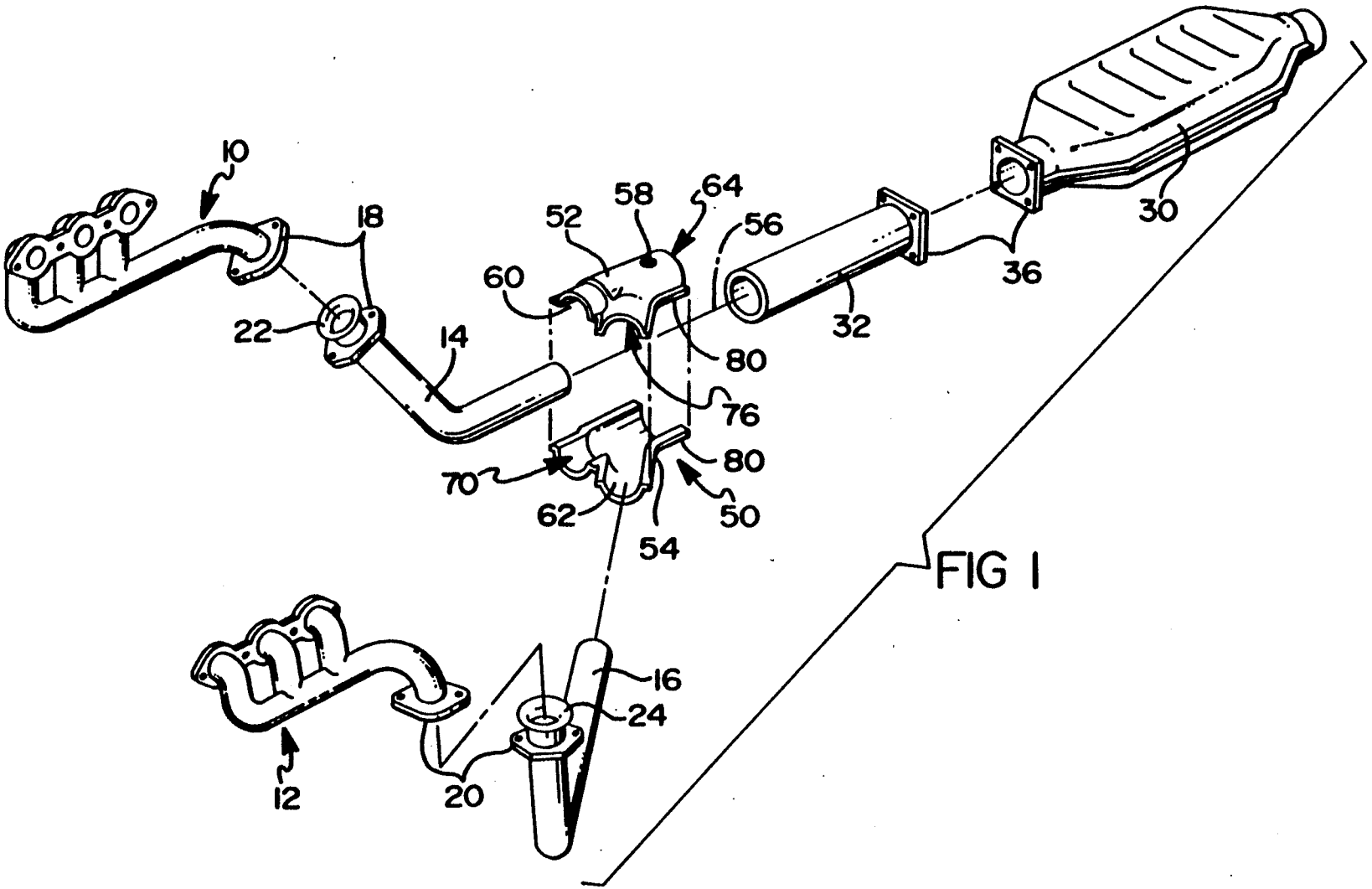
FIG. 1 is an exploded perspective view of an automobile exhaust system and the exhaust manifold of an internal combustion engine utilizing a coupling device according to the invention.

Referring to FIG. 1, a typical exhaust system for a V-6 internal combustion engine using a clam shell type coupling device according to the present invention is shown. Exhaust gases exiting from two sides of the internal combustion engine are collected by dual manifolds 10 and 12. Manifolds 10 and 12 are coupled to one end of separate exhaust pipes 14 and 16, respectively, by means of joining devices 18 and 20 and seals 22 and 24. Seals 22 and 24 inhibit leaking of the exhaust gases through joints 14 and 16. The other ends of separate exhaust pipes 14 and 16 are connected to a clam shell type coupling device 50 according to the present invention, having a Y-shaped configuration. Clam shell type coupling device 50 couples the exhaust gases from separate pipes 14 and 16 into a single pipe 32 at an outlet end of the coupling device 50. The other end of pipe 32 may then be connected to an inlet end of catalytic converter 30 (as shown) by means of a joining device 36. Alternatively, the outlet end of coupling device 50 may be connected directly to the inlet of a catalytic converter in some exhaust systems. It will be appreciated that catalytic converter 30 can be replaced with a muffler, resonator, or other exhaust system silencing device. Generally, the outlet end of catalytic converter 30 is connected to a tailpipe for exiting the converted and/or silenced exhaust gases out from underneath the vehicle (not shown).

Clam shell type coupling device 50 of the present invention generally has two half shells, a top half shell 52 and a bottom half shell 54. Each of the two half shells 52 and 54 are mirror images of each other and generally comprise three semicircular openings in which pipes 14, 16 and 32 can be positioned. When half shells 52 and 54 are combined the semicircular openings form circular orifice openings of substantially 360° for receiving and completely enclosing in fluid tight manner each of the respective ends of pipes 14, 16 and 32. When half shells 52 and 54 are brought together, a generally tubular shaped coupling device is formed that generally conforms with the tubular shape of pipes 14, 16 and 32. Further, when half shells 52 and 54 are joined, inlet orifices 60 and 62 and outlet orifice 64 are formed to receive the respective ends of pipes 14, 16 and 32. Since the coupling device 50 is in a Y-shaped configuration, half shells 52 and 54 form tubular shaped connecting chambers 70 and 76.

Generally, half shells 52 and 54 are joined together by means of welding, suitable known techniques such as MIG or TIG welding being preferable. Each of the two half shells 52 and 54 are provided with a flange 80 along their edges for providing a contact and weld area between the two half shells. Additionally, each of the pipes 14, 16 and 32 are welded within the orifices 60, 62 and 64 respectively, to connect the pipes to the coupling device 50. Although it is possible to use other methods of joining the half shells 52 and 54 together and to pipes 14, 16 and 32, welding provides a well known and highly effective method for this purpose to insure the strength and integrity of the exhaust system at the joining area.

When half shells 52 and 54 are welded together and to pipes 14, 16 and 32, an efficient and practical means for combining exhaust gases from separate pipes 14 and 16 into a single pipe 32 in a fluid tight manner is provided. The sizes of separate pipes 14 and 16 and orifices 60 and 62 are configured in conjunction with the size of outlet orifice 64 and pipe 32 so that minimal back pressure is created in the exhaust gases when combining gases from the two pipes 14 and 16 into single pipe 32. In order to avoid the creation of back pressure and to promote maximum efficiency, it is preferred that the combined cross sectional areas of inlet orifices 60 and 62 be substantially equivalent to the cross sectional area of outlet orifice 64. The elimination of back pressure on the exhaust gases prevents any undue pressures on the engine and the exhaust system itself thereby assuring that the life of the system is not reduced.

The clam shell coupling device 50 may also include in one of its half shells an aperture 58. Aperture 58 enables a fitting (not shown) to be attached to the coupling device for providing a supply of air to the coupling device 50 to combine with the exhaust gases. Addition of air into the exhaust gases increases the oxygen in the exhaust gases thereby enabling the unburned products within the exhaust gases to be more completely and efficiently converted within the catalytic converter 30. Generally, a forced air supply is connected to aperture 58 to enable even more air to be combined with the exhaust gases. In such instances when an aperture 58 and an air supply is utilized, coupling device 50 is further dimensionally configured to avoid back pressures which may be introduced by the forced air supply. Aperture 58, alternatively, enables a gas sensor (not shown) to be attached to the coupling device for sensing the presence of oxygen in the exhaust gases. If oxygen is present, the gas sensor sends a signal to the vehicle's on-board computer which will adjust the vehicle's fuel mixture and combustion timing to reduce the oxygen level.

In operation, exhaust gases introduced into separate pipes 14 and 16 by manifolds 10 and 12 from an internal combustion engine are combined by coupling device 50 into a single pipe 32. The exhaust gases are then introduced into a catalytic converter 30 (or muffler) and then through a tail pipe (not shown) to atmosphere. Coupling device 50 effectively combines the gases with minimal adverse effect on back pressure or on the strength and integrity of the exhaust system.

Figure 4:
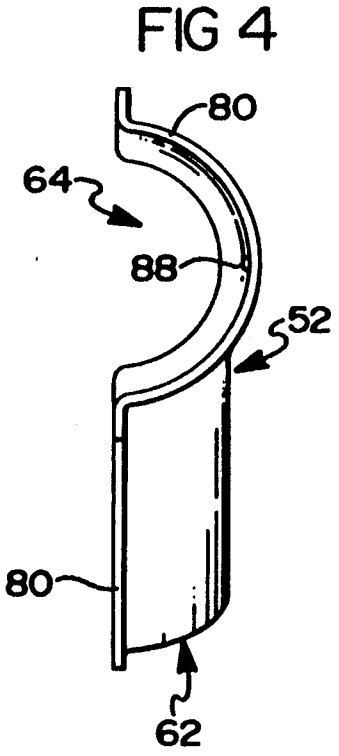
FIG. 4 is an end view of the outlet end of the half shell of FIG. 2.
Figure 2:
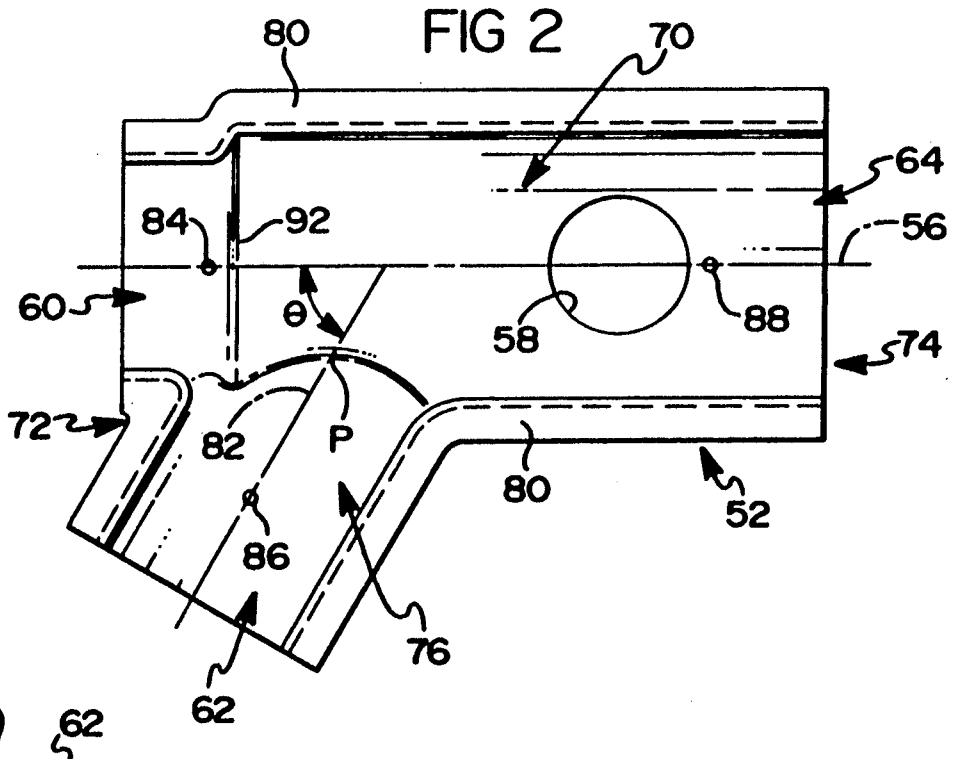
FIG. 2 is an inside view of one of the half shells of the clam shell type coupling device according to the invention.
Figure 3:
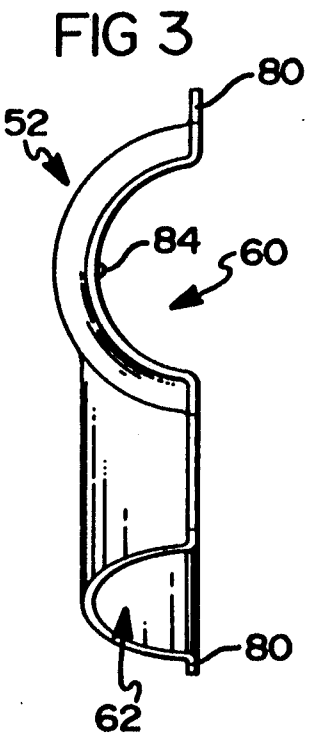
FIG. 3 is an end view of the inlet end of one of the half shell of FIG. 2.

Now turning to FIGS. 2 through 5, the features of the Y-shaped clam shell type coupling device 50 are further illustrated. FIG. 2 shows one of the half shells 52 of the clam shell type coupling device 50 viewed from the inside. It will be understood that the other half shell 54 is substantially identical to half portion 52 in a mirror image fashion. Half shell 52 of coupling device 50 has inlet end 72 and outlet end 74. Inlet end 72 combined with an inlet end of the other half shell 54 forms orifice 60. Angularly adjacent to orifice 60 is second inlet orifice 62, also associated with inlet end 72. As above, orifice 62 is formed by the combination of both half shells 52 and 54. Outlet end 74 combines with an outlet end of the other half shell 54 to form outlet orifice 64. As shown in FIG. 2, inlet orifice 60 and outlet orifice 64 have a common longitudinal axis shown by the dotted line 56. When half shells 52 and 54 are combined to form coupling device 50, two chambers 70 and 76 are formed. First chamber 70 is tubular and includes a direct passage from inlet orifice 60 through to outlet orifice 64 and is defined by longitudinal axis 56. Second chamber 76 includes the area within the coupling device 50 between inlet orifice 62 and a line "P". Line P generally defines the line of intersection between chambers 70 and 76 where exhaust gases from pipes 14 and 16 are first combined. Second chamber 76 is also tubular and has a longitudinal axis 82 going through the center of inlet orifice 62 and intersecting longitudinal axis 56 at an angle. As illustrated in FIGS. 2, 3, and 4, first chamber 70 radially expands from inlet orifice 60 to outlet orifice 64 at a plane 92 which is generally perpendicular to longitudinal axis 56. This increase in diameter of chamber 70 accommodates the exhaust gases entering device 50 through inlet orifices 60 and 62 with minimum increase in back pressure. The volume of chamber 70 increases from inlet orifice 62 to outlet orifice 64 to allow for the increased volume of exhaust gases from pipe 16 through inlet orifice 62.

Figure 5:
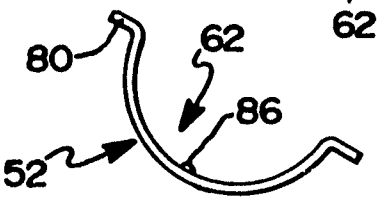
FIG. 5 is an end view of inlet opening 62 of the half shell of FIG. 2.

As can be seen from FIGS. 3 through 5, the body portion of half shell 52 is generally circular in cross sectional shape. Extending around the perimeter of half shell 52 is a flange area 80, which is generally perpendicular to the tubular portion of half shell 52 at the joining edge of flange 80 and the tubular portion. When half shell 52 is combined with half shell 54, flange 80 rests flush against the mirror image flange on half shell 54 to form a weld area.

FIG. 3 is an end view of half shell 52 shown from the inlet end 72 perpendicular to axis 56. The relationship between inlet orifices 60 and 62 for inlet pipes 14 and 16 can further be visualized from FIG. 3. FIG. 4 is an end view of the outlet end 74 of half shell 52 perpendicular to axis 56. FIG. 5 shows an end view of inlet orifice 62 perpendicular to axis 82.

Also shown in FIG. 2, aperture 58 may be provided for introducing forced air into chamber 70 or for monitoring the oxygen level in the exhaust gases. It will be appreciated that aperture 58 may be located in either half shell 52 or 54 at generally any location that accesses chamber 76 or chamber 70. If supplemental air is introduced through aperture 58 it will combine with the flow of the exhaust gases and be carried to the catalytic converter to enhance conversion of the combustion by-products in the exhaust gases. If a gas sensor is utilized, a signal indicating the presence of a predetermined level of oxygen is sent to the vehicle's computer which will make appropriate adjustments to the fuel mixture and/or combustion timing. Further shown in FIG. 2, inwardly biased dimples 84, 86 and 88 may be provided respectively near orifices 60, 62 and 64 in coupling device 50 to provide stop and positioning means to prevent the exhaust pipes 14, 16, and 32 from being inserted too far into the coupling device and interfering with the flow of exhaust gases into and through the coupling device.

Each half shell 52 and 54 may be made from any suitable metal such as low carbon steel or stainless steel that may be readily stamp formed and yet retain the strength and durability necessary in an exhaust gas system environment. Through conventional stamp forming techniques the diameters of the chambers 70 and 76 can be changed to accommodate different diameter pipes 14, 16 and 32. In like manner, the length of chamber 76 as well as the overall length of the coupling device represented by chamber 70 can be changed. In addition, the width of flange 80 can be changed to make a wider or narrower welding area. All of the above changes can be made in conventional stamp forming operations by changing the tooling to provide different coupling devices according to this invention for different exhaust systems.

One of the more typical differences between various coupling devices 50 will be the angle between the two intake orifices 60 and 62 represented by $\theta$ in FIG. 2. Due to the wide variety and orientation of V-6 and V-8 engines in the present day market, along with different spacing limitations of the vehicle chassis, the angle at which separate pipes 14 and 16 come together may vary greatly. For some exhaust systems, and thus for the preferred embodiment, the angle $\theta$ between longitudinal axes 56 and 82 is approximately 60°. However, an angle $\theta$ varying from approximately 45° to approximately 90° may be more suitable for other exhaust systems. Other modifications to the coupling device 50 will become apparent as the intricacies of different exhaust systems are observed.

The foregoing discussion discloses and describes merely an exemplary embodiment of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A device for coupling two pipes to a single pipe in a fluid tight manner, said coupling device comprising:

a first Y-shaped shell; and a second Y-shaped shell forming a substantially mirror image of said first shell;

wherein said first and second shells combine to form a first orifice adapted to receive in fluid tight manner one of said two pipes, a second orifice adapted to receive in fluid tight manner the other of said two pipes, a third orifice adapted to receive in fluid tight manner said single pipe, a first tubular shaped chamber, and a second tubular shaped chamber, said first and second orifices being at one end of said coupling device and said third orifice being at another end of said coupling device, said first orifice, first chamber, and third orifice being aligned along a common longitudinal first axis, and said second orifice and said second chamber being aligned along a common longitudinal second axis that is planar with and acute to said first axis, said first chamber radially expanding in cross sectional area from the first orifice to the third orifice, said third orifice having a cross sectional area substantially equal to combined cross sectional areas of said first and second orifices.

2. The coupling device of claim 1 wherein said first and second Y-shaped shells have planar edge portions providing an area for welding said first and second Y-shaped shells together, said edge portions extending radially away from the periphery of said shells.

3. The coupling device of claim 1 wherein the angle between said first and second axes is in a range of approximately 45° C. to approximately 90°.

4. The coupling device of claim 1 wherein the angle between said first and second axes is approximately 60°.

5. The coupling device of claim 1 wherein an inwardly biased dimple is provided in said first or second Y-shaped shells near each of said first, second, and third orifices.

6. A coupling device for use in an exhaust system of an internal combustion engine having a first manifold and exhaust pipe connected thereto, a second manifold and exhaust pipe connected thereto, and a catalytic converter or silencer having a single inlet pipe, said coupling device coupling said first and second exhaust pipes to said single inlet pipe, comprising:

a first Y-shaped shell having a peripheral edge;

a second Y-shaped shell having a peripheral edge forming a substantially mirror image of said first shell, wherein a first orifice of substantially 360° adapted to couple with said first exhaust pipe, a second orifice of substantially 360° adapted to couple with said second exhaust pipe, and a third orifice of substantially 360° adapted to couple with said single inlet pipe are formed when said first and second shells are joined in edge mating relationship, said first orifice and said third axis being concentrically aligned along a first longitudinal axis;

said first and second shells joining to form first and second tubular shaped intersecting chambers, said first chamber extending and defining a pathway of increasing cross sectional area between said first orifice and said third orifice, and said second chamber extending and defining a pathway between said second orifice and said first chamber, said third orifice having a cross sectional area substantially equal to combined cross sectional areas of said first and second orifices; and an inwardly biased dimple in said first or second Y-shaped shells near each of said first, second and third orifices, wherein said dimples limit the depth of insertion of said exhaust pipes and said single pipe into said coupling device.

7. The coupling device of claim 6 wherein said second orifice and said second chamber have a second longitudinal axis that is coplanar with and oblique to said first longitudinal axis.

8. The coupling device of claim 7 wherein said first and second axes define an angle in a range of approximately 45° to approximately 90°.

9. The coupling device of claim 7 wherein said angle is approximately 60°.

10. The coupling device of claim 6 wherein said peripheral edges of said first and second shells have radially extending flange portions for welding said first and second shells together, wherein said flange portions and said first longitudinal axis define a common plane.

11. The coupling device of claim 6 wherein one of said first or second shells includes an aperture for introducing air into said device.

12. The coupling device of claim 6 wherein one of said first or second shells includes an aperture for receiving a means for sensing predetermined levels of oxygen within said device.

* * * * *

UNITED STATES PATENT AND TRADEMARK OFFICE

CERTIFICATE OF CORRECTION

PATENT NO. : 5,134,852

DATED : August 4, 1992

INVENTOR(S) : Andrew M. Weeks

It is certified that error appears in the above-identified patent and that said Letters Patent is hereby corrected as shown below:

Column 6, line 33, claim 3, "45°C." should be --45°--.

Column 6, line 57, claim 6, "axis" should read --orifice--

Signed and Sealed this

Twenty-sixth Day of October, 1993

*Attest:*

*Attesting Officer*

Bruce Lehman

BRUCE LEHMAN

*Commissioner of Patents and Trademarks*